US005116802A

United States Patent [19]

Arai et al.

[11] Patent Number: 5,116,802

[45] Date of Patent: May 26, 1992

[54] HEAT-SENSITIVE RECORDING MATERIAL

[75] Inventors: Naoto Arai, Ikeda; Kazuo Watanabe, Itami, both of Japan

[73] Assignee: Kanzaki Paper Manufacturing Co., Ltd., Tokyo, Japan

[21] Appl. No.: 644,583

[22] Filed: Jan. 23, 1991

[30] Foreign Application Priority Data

Jan. 24, 1990 [JP] Japan ..... 2-15581

[51] Int. Cl.[5] ..... B41M 5/30

[52] U.S. Cl. ..... 503/208; 503/209; 503/221

[58] Field of Search ..... 503/200, 208, 209, 225, 503/221; 427/150–152

[56] References Cited

U.S. PATENT DOCUMENTS 4,764,500 8/1988 Araki et al. ..... 503/209

FOREIGN PATENT DOCUMENTS 245836 4/1987 European Pat. Off. ..... 503/209
306916 3/1989 European Pat. Off. ..... 503/209
373561 3/1990 European Pat. Off. ..... 503/209
01150576 4/1989 Japan ..... 503/209
2-25377 1/1990 Japan ..... 503/209

OTHER PUBLICATIONS

Patent Abstracts of Japan vol. 13, No. 411 dated Sep. 11, 1989.

Patent Abstracts of Japan vol. 14, No. 172 published on Apr. 4, 1990.

*Primary Examiner*—Pamela R. Schwartz

*Attorney, Agent, or Firm*—Larson and Taylor

[57] ABSTRACT

The invention provides a heat-sensitive recording material comprising (a) a base sheet and (b) a heat-sensitive recording layer formed on the base sheet and comprising a colorless or pale-colored basic dye, a color developing material which develops a color on contact with the dye, and a heat-fusible material, the recording material being characterized in that the basic dye comprises 3-di(n-butyl)amino-6-methyl-7-phenylaminofluoran, and that the heat-fusible material comprises di(p-methylbenzyl) oxalate.

15 Claims, No Drawings

HEAT-SENSITIVE RECORDING MATERIAL

BACKGROUND OF THE INVENTION

1. Field of the Invention

The present invention relates to a heat-sensitive recording material and more particularly to a heat-sensitive recording material of high sensitivity which can be stored in a high-temperature environment with substantially no reduction in the whiteness of white area (unrecorded area) on the recording material and without adhesion of residual substances to the thermal head.

2. Prior Art

Heat-sensitive recording materials are well known which make use of the color forming reaction of a colorless or pale-colored basic dye with a color developing material such that the two materials are brought into contact with each other by heating to produce a color image.

Since the above heat-sensitive recording materials are relatively inexpensive, and record images are formed thereon with use of a compact recording device with an easy maintenance, the recording materials are widely used for various applications. With the diversity of applications, these recording materials have been more frequently stored in high-temperature environments, as in a storehouse in summer time or in the storeroom of a ship cruising on the sea in the tropical zone. Because of a need for inexpensive miniaturized recording devices, new type recording devices are currently available which do not have ventilating means that are almost always provided in conventional recording devices, and which are equipped with most simplified power source possible. However, the new type recording devices have drawbacks due to these features. The heat-sensitive recording material stored as rolled in, e.g., an energized small-size facsimile device is invariably exposed to the heat generated from the power source to develop undesired color at least in part, thereby easily becoming impaired in the whiteness of the background white area. Due to the miniaturization of power source, a reduced amount of energy is applied for recording so that record images of high density can not be produced using conventional color developing system. In addition, an increased amount of residual substances such as a basic dye, color developing material, heat-fusible material and other additives fused in the recording layer are piled up on the thermal head since the recording proceeds before the viscosity of fused materials sufficiently decreases.

SUMMARY OF THE INVENTION

An object of the present invention is to provide a heat-sensitive recording material of high sensitivity which, even when exposed to high-temperature environments, assures substantially no reduction in the whiteness of background white area and is free of adhesion of residual substances to the thermal head.

We conducted research and found that the object of the invention can be accomplished by use of a heat-sensitive recording material comprising a base sheet and a heat-sensitive recording layer formed on the base sheet and comprising a colorless or pale-colored basic dye, a color developing material which develops a color on contact with the dye, and a heat-fusible material, the recording material being characterized in that the basic dye comprises 3-di(n-butyl)amino-6-methyl-7-phenylaminofluoran, and that the heat-fusible material comprises di(p-methylbenzyl) oxalate.

DETAILED DESCRIPTION OF THE INVENTION

The recording material of the present invention has the important feature of containing the specific basic dye and the specific heat-fusible material in combination.

As described above, the recording material of the invention contains the basic dye comprising 3-di(n-butyl)amino-6-methyl-7-phenylaminofluoran. Although the use of such dye results in little or no reduction in the whiteness of white area on exposure to a high-temperature environment, the dye poses the serious defect of having reduced color developing property when a small amount of energy is applied. However, we found that when di(p-methylbenzyl) oxalate is used as a heat-fusible material in combination with the dye, a pronounced improvement of color developing property can be achieved while the foregoing feature of the dye is retained. Our further discovery was as follows. When a heat-sensitive recording layer contains at least one heat-fusible material having a melting point of about 80° to about 105° C. conjointly with di(p-methylbenzyl) oxalate, the color developing property is further enhanced, and the record images of high density can be formed even on application of low energy, and the amount of residual substances deposited on the thermal head is extremely decreased.

While there is no restriction on the total amount of the heat-fusible material comprising di(p-methylbenzyl) oxalate alone or in combination with another heat-fusible material (other than di(p-methylbenzyl) oxalate), a preferred amount of the heat-fusible material is about 50 to 1000 parts by weight, preferably about 100 to 500 parts by weight, per 100 parts by weight of the specific basic dye. In order to achieve the object of the invention, namely to retain whiteness of the background white portion at high temperature and to prevent adhesion of residual substances, and further to improve the color developing ability, the di(p-methylbenzyl) oxalate which is used in combination with another heat-fusible material is required to account for about 25 to about 95% by weight, preferably about 30 to about 80% by weight, of the total amount of the heat-fusible materials. Various conventionally used substances are usable as heat-fusible materials having a melting point of about 80° to about 105° C. which are used in combination with di(p-methylbenzyl) oxalate. Examples of such heat-fusible materials are stearic acid amide, methylol stearamide, 1,2-bis(phenoxy)ethane, 1,2-bis(4-methylphenoxy)ethane, 1,2-bis(3-methylphenoxy)ethane, 1-(4-methoxyphenoxy)-2-(2-methylphenoxy)ethane, 1,4-dimethoxynaphthalene, 1,4-diethoxynaphthalene, dibenzyl terephthalate, 1-hydroxy-2-naphthoic acid phenyl ester, dibenzyl oxalate, 2-hydroxy-4-benzyloxybenzophenone, p-benzylbiphenyl, etc. Among them, it is preferred to use 1,2-bis(phenoxy)ethane, 1,2-bis(3-methylphenoxy)ethane and 1-(4-methoxyphenoxy)-2-(2-methylphenoxy)ethane because they are highly compatible with the specific basic dye and di(p-methylbenzyl) oxalate to be used in the invention, and serve to produce heat-sensitive recording materials of high sensitivity which can accomplish recording without the adhesion of residual substance to the thermal head due to their low viscosity when fused.

As stated hereinbefore, the above specific basic dye and the specific heat-fusible material(s) are used in the present invention. Other basic dyes can also be used so far as they do not impair the contemplated effect of the invention. Examples of such basic dyes are 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-6-dimethylaminophthalide, 3,3-bis(2-phenylindol-3-yl)-6-dimethylaminophthalide, 3-p-dimethylamino-phenyl-3-(1-methylpyrrol-3-yl)-6-dimethylaminophthalide and like triarylmethane-based dyes; 4,4'-bis-dimethylaminobenzhydrylbenzylether, N-halophenylleucoauramine, N-2,4,5-trichlorophenyl-leucoauramine and like diphenylmethane-based dyes; benzoylleucomethylene blue, p-nitrobenzoyl-leucomethylene blue and like thiazine-based dyes; 3-methyl-spiro-dinaphthopyrane, 3-ethyl-spiro-dinaphthopyrane, 3-phenyl-spiro-dinaphthopyrane, 3-benzyl-spiro-dinaphthopyrane, 3-methyl-naphtho-(6'-methoxy-benzo)spiropyrane, 3-propyl-spiro-dibenzopyrane and like spiro-based dyes; rhodamine-B-anilinolactam, rhodamine(p-nitroanilino)lactam, rhodamine(o-chloroanilino)lactam and like lactam-based dyes; 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-(N-methyl-N-benzyl-amino)fluoran, 3-diethylamino-7-(N-chloroethyl-N-methylamino)fluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-diethylamino-7-(2-carbomethoxy-phenylamino)fluoran, 3-(N-ethyl-N-isoamyl-)amino-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-(N-ethyl-N-tetrahydrofurfuryl)amino-6-methyl-7-phenylaminofluoran, 3-(N-methyl-N-n-propyl)amino-6-methyl-7-phenylaminofluoran, 3-pyrrolidino-6-methyl-7-p-butylphenylaminofluoran, 3-(N-ethyl-N-n-propyl)amino-6-methyl-7-phenylaminofluoran, 3-(N-ethyl-N-isobutyl)amino-6-methyl-7-phenylaminofluoran, 3-(N-methyl-N-n-hexyl-)amino-6-methyl-7-phenylaminofluoran, 3-(N-ethyl-N-n-hexyl)amino-6-methyl-7-phenylaminofluoran, 3-(N-ethyl-N-cyclopentyl)amino-6-methyl-7-phenylaminofluoran and like fluoran-based dyes; etc. The additional basic dyes useful in the invention are not limited to the examples given above.

The additional dyes, if used, should preferably account for about 20% by weight or less of the total amount of the basic dyes used.

The color developing material to be used in combination with the above basic dye can be selected from various conventional color developing materials. Examples of useful color developing materials are as follows: phenolic compounds such as 4-tert-butyl phenol, α-naphthol, β-naphthol, 4-acetylphenol, 4-tert-octylphenol, 4,4'-sec-butylidene-diphenol, 4-phenylphenol, 4,4'-dihydroxy-diphenylmethane, 4,4'-isopropylidenediphenol, hydroquinone, 4,4'-cyclohexylidenediphenol, 4,4'-(1,3-dimethylbutylidene)bis-phenol, 4,4'-dihydroxydiphenylsulfide, 4,4'-thiobis-(6-tert-butyl-3-methylphenol), 4,4'-dihydroxydiphenylsulfone, 4-hydroxy-4'-methyldiphenylsulfone, 4-hydroxy-4'-methoxy-diphenylsulfone, 4-hydroxy-4'-isopropoxydiphenylsulfone, 4-hydroxy-3',4'-trimethylenediphenylsulfone, 4-hydroxy-3',4'-tetramethylenediphenylsulfone, bis(3-allyl-4-hydroxy-phenyl)sulfone, 1,3-di[2-(4-hydroxyphenyl)-2-propyl]benzene, hydroquinone monobenzyl ether, bis(4-hydroxyphenyl)acetic acid butyl ester, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, ethyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, novolak phenol resin, phenolic polymer and the like; aromatic carboxylic acids such as benzoic acid, p-tert-butylbenzoic acid, trichlorobenzoic acid, terephthalic acid, 3-sec-butyl-4-hydroxy-benzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3,5-di-tert-butylsalicylic acid, 3-benzylsalicylic acid, 3-(α-methylbenzyl)salicylic acid, 3-chloro-5-(α-methylbenzyl)salicylic acid, 3-phenyl-5-(α, α-dimethylbenzyl)salicylic acid, 3,5-di-α-methylbenzylsalicylic acid and the like; organic acidic substances such as salts of the above-exemplified phenolic compounds or aromatic carboxylic acids or the like with polyvalent metals such as zinc, magnesium, aluminum, calcium, titanium, manganese, tin, nickel and the like. These color developing materials can be used singly or at least two of them are usable in mixture.

The proportions of the above specific basic dye and the color developing material to be used in the invention can be suitably determined without specific limitation according to the kinds of color developing material used. Generally the color developing material is used in an amount of about 100 to about 700 parts by weight, preferably about 150 to about 400 parts by weight, per 100 parts by weight of the above specific basic dye.

The coating composition for forming the heat-sensitive recording layer can be prepared usually by dispersing the above components conjointly or separately with an agitating and pulverizing means such as a ball mill, attritor, sand mill or the like using water as a dispersing medium.

The contemplated effect of the invention can be achieved to a remarkable extent by pulverizing a mixture of the specific basic dye and the specific heat-fusible material using a horizontal sand mill or the like to give particles of about 1.2 μm or less, preferably about 0.9 μm or less, in mean particle size.

The coating composition may usually contain a binder such as starches, hydroxyethyl cellulose, methyl cellulose, carboxymethyl cellulose, gelatin, casein, gum arabic, polyvinyl alcohol, modified polyvinyl alcohols such as carboxyl group-modified polyvinyl alcohol, sulfone group-modified polyvinyl alcohol, acetoacetyl group-modified polyvinyl alcohol or silicon-modified polyvinyl alcohol, salts of styrene-maleic anhydride copolymer, or salts of styrene-acrylic acid copolymer, styrene-butadiene copolymer emulsion or the like. The binder is used in an amount of about 2 to about 40% by weight, preferably about 5 to about 25% by weight, based on the total solids content of the coating composition. It is possible to use at least two of these binders in mixture.

The coating composition may further contain auxiliaries such as sodium dioctylsulfosuccinate, sodium dodecylbenzenesulfonate, sodium lauryl sulfate, metal salts of fatty acids and like dispersants, defoaming agents, fluorescent dyes, coloring dyes, etc.

In order to further reduce the adhesion of residual substances to the thermal head, inorganic pigments may be incorporated and include, for example, kaolin, clay, talc, calcium carbonate, calcined clay, titanium oxide, diatomaceous earth, particulate anhydrous silica, activated clay and the like.

To prevent the recording material from sticking to the recording device or the thermal head on contact therewith, it is possible to use a dispersion or an emulsion of stearic acid, polyethylene, carnauba wax, paraffin wax, zinc stearate, calcium stearate or the like.

There is not a specific restriction on the method of forming the recording layer of the heat-sensitive recording material of the invention. For example, the recording layer can be formed by applying the coating composition to a base sheet by an air knife coater, blade coater, bar coater, rod blade coater, gravure coater, curtain coater or other suitable coaters, and drying the coating layer.

The amount of the coating composition to be applied is not specifically limited and is generally about 1.5 to about 12 g/m$^2$, preferably about 2.5 to about 10 g/m$^2$ on dry basis.

Examples of materials for base sheets useful in the invention are papers, plastics films, synthetic papers, etc. among which papers are most preferred in terms of costs and suitability for coating.

Since the recording layer of the heat-sensitive recording materials of the invention is formed from the specific dye and the specific heat-fusible material, the recording material can exhibit very little reduction in the whiteness even when exposed to a high-temperature environment and causes substantially no adhesion of residual substances to the thermal head, and thus can produce excellent effects as heat-sensitive recording material of high sensitivity.

Other techniques used in the art for production of heat-sensitive recording materials can be employed if necessary and include, for example, provision of a protective layer on the front side and/or the rear side of the heat-sensitive recording material, application of undercoats on base sheets, application of an adhesive on the rear side of recording material, etc.

EXAMPLES

The present invention will be described below in more detail with reference to the following examples, but the invention is not limited thereto. In the examples, "parts" and "percentages" are all by weight unless otherwise specified.

EXAMPLE 1

(1) Preparation of Dispersion A

| | |
|---|---|
| 3-Di(n-butyl)amino-6-methyl-7-phenylaminofluoran | 10 parts |
| Di(p-methylbenzyl) oxalate | 30 parts |
| 5% Aqueous solution of methylcellulose | 30 parts |
| Water | 20 parts |

The mixture of these components was pulverized by a horizontal sand mill to an average particle size of 0.8 μm.

(2) Preparation of Dispersion B

| | |
|---|---|
| 4,4'-Isopropylidenediphenol | 20 parts |
| 5% Aqueous solution of methylcellulose | 15 parts |
| Water | 15 parts |

The mixture of these components was pulverized by a horizontal sand mill to an average particle size of 1.0 μm.

(3) Formation of heat-sensitive recording layer

A 90 parts quantity of Dispersion A, 50 parts of Dispersion B, 20 parts of silicon oxide pigment, 10 parts of calcium carbonate pigment, 60 parts of a 15% aqueous solution of polyvinyl alcohol, 50 parts of a 20% aqueous solution of oxidized starch, 30 parts of a 30% aqueous dispersion of zinc stearate and 160 parts of water were mixed together with stirring, giving a coating composition for heat-sensitive recording layer formation.

The coating composition thus obtained was applied to a base paper weighing 48 g/m$^2$ with use of a rod blade coater in an amount of 5 g/m$^2$ on dry basis and dried, giving a heat-sensitive recording layer.

EXAMPLE 2

Preparation of Dispersion C

| | |
|---|---|
| 3-Di(n-butyl)amino-6-methyl-7-phenylaminofluoran | 10 parts |
| Di(p-methylbenzyl) oxalate | 15 parts |
| 1,2-Bis(3-methylphenoxy)ethane | 15 parts |
| 5% Aqueous solution of methylcellulose | 30 parts |
| Water | 20 parts |

The mixture of these components was pulverized by a horizontal sand mill to an average particle size of 0.8 μm.

A heat-sensitive recording paper was prepared in the same manner as in Example 1 with the exception of using, in formation of heat-sensitive recording layer, 90 parts of Dispersion C in place of 90 parts of Dispersion A.

EXAMPLE 3

A heat-sensitive recording paper was prepared in the same manner as in Example 2 except that 1-(4-methoxyphenoxy)-2-(2-methylphenoxy)ethane was used in place of 1,2-bis(3-methylphenoxy)ethane in the preparation of Dispersion C and that 4-hydroxy-4'-isopropoxydiphenylsulfone was used in place of 4,4'-isopropylidenediphenol in the preparation of Dispersion B.

Comparison Example 1

A heat-sensitive recording paper was produced in the same manner as in Example 1 with the exception of using 3-(N-ethyl-N-isoamyl)amino-6-methyl-7-phenylaminofluoran in place of 3-di(n-butyl)amino-6-methyl-7-phenylaminofluoran in the preparation of Dispersion A.

COMPARISON EXAMPLE 2

A heat-sensitive recording paper was obtained in the same manner as in Example except that 3-(N-methyl-N-cyclohexyl)amino-6-methyl-7-phenylaminofluoran was used in place of 3-di(n-butyl)amino-6-methyl-7-phenylaminofluoran in the preparation of Dispersion A and that 4-hydroxy-4'-isopropoxydiphenylsulfone was used in place of 4,4'-isopropylidenediphenol in the preparation of Dispersion B.

COMPARISON EXAMPLE 3

A heat-sensitive recording paper was produced by the same procedure as in Example 2 with the exception of using, in the preparation of Dispersion C, 6 parts of di(p-methylbenzyl) oxalate and 24 parts of 1,2-bis(3-methylphenoxy)ethane in place of 15 parts of di(p-methylbenzyl) oxalate and 15 parts of 1,2-bis(3-methylphenoxy)ethane.

COMPARISON EXAMPLE 4

A heat-sensitive recording paper was prepared in the same manner as in Example 2 with the exception of using p-benzylbiphenyl in place of di(p-methylbenzyl) oxalate in the preparation of Dispersion C.

COMPARISON EXAMPLE 5

A heat-sensitive recording paper was produced in the same manner as in Example 2 except that 15 parts of dibenzyl oxalate and 15 parts of 1-(4-methoxyphenoxy)-2-(2-methylphenoxy)ethane were used in lieu of 15 pats of di(p-methylbenzyl) oxalate and 15 parts of 1,2-bis(3-methylphenoxy)ethane in the preparation of Dispersion C and that 4-hydroxy-4'-isopropoxydiphenylsulfone was used in place of 4,4'-isopropylidenediphenol in the preparation of Dispersion B.

With use of a tester for color developing abiality of heat-sensitive recording material (applied voltage: 14 V, period of pulse: 0.51 ms, Model TH-PMD, manufactured by Ohkura Denki Kabushiki Kaisha), the 8 kinds of heat-sensitive recording papers obtained above were subjected to a recording test with the pulse width maintained at 0.30 ms. Using the recording paper on which record images were thus formed, the color density of the record images and the reflecting density of the background white portions were measured by Macbeth reflection densitometer (Model RD-914, manufactured by Macbeth Corporation, U.S.A.). Table 1 shows the results. Further, after the thus recorded papers were allowed to stand at 60° C. in an atmosphere of 12% RH for 3 days, the color density of the record images and the reflecting density of the background white portions were measured, with the results shown below in Table 1.

The adhesion of residual substances to the thermal head was evaluated by forming five pieces of wholly black-colored A4-type recorded papers with use of a facsimile machine HIFAX-400 (manufactured by Hitachi, Ltd.) and observing the thermal head of the machine.

The amount of residual substances that adhered to the thermal head was evaluated according to the following criteria.

A: Substantially no residual substance adhered to the head.

B: A small amount of residual substances adhered to the head but substantially no problem was caused in use.

C: A very large amount of residual substances adhered to the head.

TABLE 1

| | Untreated | | Stored at 60° C., under 12% RH for 3 days | | |
|---|---|---|---|---|---|
| | Density of white portion | Density of recorded portion | Density of white portion | Density of recorded portion | Adhesion of residual substances |
| Example 1 | 0.05 | 1.09 | 0.12 | 1.05 | B |
| Example 2 | 0.05 | 1.24 | 0.18 | 1.18 | A |
| Example 3 | 0.05 | 1.29 | 0.17 | 1.24 | A |
| Comp. Ex. 1 | 0.07 | 1.13 | 0.42 | 1.05 | C |
| Comp. Ex. 2 | 0.06 | 1.07 | 0.38 | 0.94 | C |
| Comp. Ex. 3 | 0.05 | 1.11 | 0.24 | 0.98 | B |
| Comp. Ex. 4 | 0.05 | 1.02 | 0.56 | 0.75 | B |
| Comp. Ex. 5 | 0.05 | 1.05 | 0.49 | 0.81 | B |

As clear from the results shown in Table 1, the heat-sensitive recording materials obtained in all examples of the present invention are highly sensitive, exhibit very little deterioration in the whiteness of the background portions thereof even when stored at a high temperature and are substantially free of adhesion of residual substances to the thermal head.

We claim:

1. A heat-sensitive recording material comprising (a) a base sheet and (b) a heat-sensitive recording layer formed on the base sheet and comprising a colorless or pale-colored basic dye, a color developing material which develops a color on contact with the dye, and a heat-fusible material, the recording material being characterized in that the basic dye comprises 3-di(n-butyl-)amino-6-methyl-7-phenylaminofluoran, and that the heat-fusible material comprises di(p-methylbenzyl) oxalate.

2. A heat-sensitive recording material according to claim 1 wherein the heat-fusible material consists essentially of di(p-methylbenzyl) oxalate.

3. A heat-sensitive recording material according to claim 1 wherein the heat-fusible material is a mixture of di(p-methylbenzyl) oxalate and at least one heat-fusible material having a melting point of about 80° to about 105° C.

4. A heat-sensitive recording material according to claim 3 wherein the heat-fusible material having a melting point of about 80° to about 105° C. is at least one compound selected from the group consisting of stearic acid amide, methylol stearamide, 1,2-bis(phenoxy)ethane, 1,2-bis(4-methylphenoxy)ethane, 1,2-bis(3-methylphenoxy)ethane, 1-(4-methoxyphenoxy)-2-(2-methylphenoxy)ethane, 1,4-dimethoxynaphthalene, 1,4-diethoxynaphthalene, dibenzyl terephthalate, 1-hydroxy-2-naphthoic acid phenyl ester, dibenzyl oxalate, 2-hydroxy-4-benzyloxybenzophenone and p-benzylbiphenyl.

5. A heat-sensitive recording material according to claim 3 wherein the heat-fusible material having a melting point of about 80° to about 105° C. is at least one compound selected from the group consisting of 1,2-bis(phenoxy)ethane, 1,2-bis(3-methylphenoxy)ethane and 1-(4-methoxyphenoxy)-2-(2-methylphenoxy)ethane.

6. A heat-sensitive recording material according to claim 3 wherein the di(p-methylbenzyl) oxalate accounts for about 25 to about 95% by weight of the total amount of the heat-fusible materials.

7. A heat-sensitive recording material according to claim 3 wherein the di(p-methylbenzyl) oxalate accounts for about 30 to about 80% by weight of the total amount of the heat-fusible materials.

8. A heat-sensitive recording material according to claim 1 wherein the heat-fusible material is used in an amount of about 50 to 1000 parts by weight per 100 parts by weight of 3-di(n-butyl)amino-6-methyl-7-phenylaminofluoran.

9. A heat-sensitive recording material according to claim wherein the heat-fusible material is used in an amount of about 100 to 500 parts by weight per 100 parts by weight of 3-di(n-butyl)amino-6-methyl-7-phenylaminofluoran.

10. A heat-sensitive recording material according to claim 1 wherein the basic dye is a mixture of 3-di(n-butyl)amino-6-methyl-7-phenylaminofluoran and other colorless or pale-colored basic dye.

11. A heat-sensitive recording material according to claim 10 wherein the other colorless or pale-colored basic dye is used in an amount of up to about 20% by weight based on the total amount of the basic dyes.

12. A heat-sensitive recording material according to claim 1 wherein the color developing material is used in an amount of about 100 to about 700 parts by weight per 100 parts by weight of 3-di(n-butyl)amino-6-methyl-7-phenylaminofluoran.

13. A heat-sensitive recording material according to claim 1 wherein the color developing material is used in an amount of about 150 to about 400 parts by weight per 100 parts by weight of 3-di(n-butyl)amino-6-methyl-7-phenylaminofluoran.

14. A heat-sensitive recording material according to claim 1 wherein the heat-sensitive recording layer further contains one or more binders selected from the group consisting of starch, hydroxyethyl cellulose, methyl cellulose, carboxymethyl cellulose, gelatin, casein, gum arabic, polyvinyl alcohol, modified polyvinyl alcohols, salts of styrene-maleic anhydride copolymer, salts of styrene acrylic acid copolymer and styrene-butadiene copolymer.

15. A heat-sensitive recording material according to claim 14 wherein the binder is used in an amount of about 2 to about 40% by weight based on the total solids of the heat-sensitive recording layer.

* * * * *